US008848948B1

(12) United States Patent
Daniels

(10) Patent No.: US 8,848,948 B1
(45) Date of Patent: Sep. 30, 2014

(54) ROTATABLE CHRISTMAS TREE STAND WITH AUDIO PLAYER DOCK

(76) Inventor: Duvall Daniels, Jamaica, NY (US)

( * ) Notice: Subject to any disclaimer, the term of this patent is extended or adjusted under 35 U.S.C. 154(b) by 338 days.

(21) Appl. No.: 13/286,319

(22) Filed: Nov. 1, 2011

(51) Int. Cl.
*G09F 27/00* (2006.01)
*H04B 3/00* (2006.01)

(52) U.S. Cl.
USPC ..... 381/124; 381/77

(58) Field of Classification Search
CPC ..... G09F 27/00; H04R 1/028; A47G 33/06; A47G 33/126
USPC ..... 381/124, 77; 700/94; 248/521, 523, 248/349.1
See application file for complete search history.

(56) References Cited

U.S. PATENT DOCUMENTS 5,190,261 A 3/1993 Tetting
5,647,569 A 7/1997 Sofy
5,878,989 A * 3/1999 Allman ..... 248/522
6,247,991 B1 * 6/2001 Chen ..... 446/242
6,382,582 B1 * 5/2002 Brown ..... 248/521
D491,839 S 6/2004 Andrews-Carter
7,679,521 B1 3/2010 Gavia
2003/0214805 A1 11/2003 Chen et al.
2004/0001601 A1 * 1/2004 Wang ..... 381/124
2007/0157511 A1 7/2007 Solak
2008/0187155 A1 * 8/2008 Hou ..... 381/300

* cited by examiner

*Primary Examiner* — Vivian Chin
*Assistant Examiner* — Douglas Suthers
(74) *Attorney, Agent, or Firm* — Kyle A. Fletcher, Esq.

(57) ABSTRACT

The Christmas tree is a fake Christmas tree rotatably engaged with respect to a stand having rotating means integrated thereon. The stand features a USB port and MP3 dock that enables audio to be played upon speakers vertically arranged upon said tree. The Christmas tree shall be either permanently or temporarily affixed to said stand. The rotating means of the stand consist of a motor and gearing system that can optionally provide different rates of rotation of said Christmas tree. An optional light system may be included to illuminate said Christmas tree.

11 Claims, 4 Drawing Sheets

ROTATABLE CHRISTMAS TREE STAND WITH AUDIO PLAYER DOCK

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of Christmas trees, more specifically, a Christmas tree and stand that includes multi-media functions integrated therein.

B. Discussion of the Prior Art

As a preliminary note, it should be stated that there is an ample amount of prior art that deals with Christmas trees generally. However, no prior art discloses a Christmas tree and stand wherein said stand can rotate the Christmas tree thereon; wherein said tree includes speakers that are vertically arranged on said tree and which play audio from either a USB drive or MP3 player located on said stand; wherein the stand and Christmas tree may also provide an optional lighting system so as to illuminate said tree; wherein said tree is a fake Christmas tree that is either temporarily or permanently affixed to said stand.

The Sofy patent (U.S. Pat. No. 5,647,569) discloses a rotating Christmas tree stand having a music box that also plays music. However, the Christmas tree stand is only a stand for the support of a fresh Christmas tree and does not feature a fake Christmas tree having speakers integrated vertically thereon.

The Chen et al. Patent Application Publication (U.S. Pub. No. 2003/0214805) discloses an artificial Christmas tree with a speaker. However, the artificial Christmas tree is not supported upon a rotating base wherein an mp3 dock is provided for customized musical means working in conjunction with a plurality of speakers that extend vertically upon said Christmas tree.

The Andrews-Carter patent (U.S. Pat. No. Des. 491,839) illustrates an ornamental design for a combination artificial Christmas tree and musical speaker. However, the claimed design does not teach a motorized stand that rotates a Christmas tree containing speakers vertically arranged thereon.

The Gavia et al. patent (U.S. Pat. No. 7,679,521) discloses a Christmas tree with a speaker. However, the Christmas tree is directed to the extinguishing and detection of smoke and fire, and is not capable of rotating a Christmas tree while playing music from a USB or MP3 dock located on said stand.

The Solak Patent Application Publication (U.S. Pub. No. 2007/0157511) discloses a Christmas tree stand with a sound playback device that includes a speaker. However, the Christmas tree stand is not capable of rotating a Christmas tree that includes speakers that are vertically arranged on said Christmas tree; wherein the speakers play audio files from a USB drive or MP3 player positioned upon said tree stand.

The Tetting patent (U.S. Pat. No. 5,190,261) discloses a rotatable tree stand with electric outlets. However, the rotatable tree stand does not include a Christmas tree permanently affixed thereon in which said tree includes speakers that are vertically arranged thereon, which play audio from either a MP3 or USB drive located with respect to said stand.

While the above-described devices fulfill their respective and particular objects and requirements, they do not describe a Christmas tree and stand wherein said stand can rotate the Christmas tree thereon; wherein said tree includes speakers that are vertically arranged on said tree and which play audio from either a USB drive or MP3 player located on said stand; wherein the stand and Christmas tree may also provide an optional lighting system so as to illuminate said tree; wherein said tree is a fake Christmas tree that is either temporarily or permanently affixed to said stand. In this regard, the Christmas tree departs from the conventional concepts and designs of the prior art.

SUMMARY OF THE INVENTION

The Christmas tree is a fake Christmas tree rotatably engaged with respect to a stand having rotating means integrated thereon. The stand features a USB port and MP3 dock that enables audio to be played upon speakers vertically arranged upon said tree. The Christmas tree shall be either permanently or temporarily affixed to said stand. The rotating means of the stand consist of a motor and gearing system that can optionally provide different rates of rotation of said Christmas tree. An optional light system may be included to illuminate said Christmas tree.

An object of the invention is to provide a rotating Christmas tree that can simultaneously play audio from speakers that are vertically arranged upon said Christmas tree.

An even further object of the invention is to provide an optional light system that may be included to illuminate said Christmas tree while in rotation.

An even further object of the invention is to provide a fake Christmas tree that is not real or requiring of any maintenance that would typically be associated with a fresh Christmas tree.

A further object of the invention is to provide a rotating means included within the stand that rotates the Christmas tree and is composed of a motor and gearing system.

An even further object of the invention is to provide the rotating means with the ability to selectively elect varying rotational speeds outputted by said rotating means onto said Christmas tree.

A further object of the invention is to provide a Christmas tree that may be either permanently affixed to said stand or temporarily affixed to said stand.

These together with additional objects, features and advantages of the Christmas tree will be readily apparent to those of ordinary skill in the art upon reading the following detailed description of presently preferred, but nonetheless illustrative, embodiments of the Christmas tree when taken in conjunction with the accompanying drawings.

In this respect, before explaining the current embodiments of the Christmas tree in detail, it is to be understood that the Christmas tree is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the Christmas tree.

It is therefore important that the claims be regarded as including such equivalent construction insofar as they do not depart from the spirit and scope of the Christmas tree. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention:

In the drawings:

FIG. 4A illustrates a perspective view of the stand and Christmas tree in an embodiment wherein the Christmas tree may be temporarily affixed to said stand and in which cords having plugged ends are provided to aid in separation there between.

DETAILED DESCRIPTION OF THE EMBODIMENT

Figure 1:
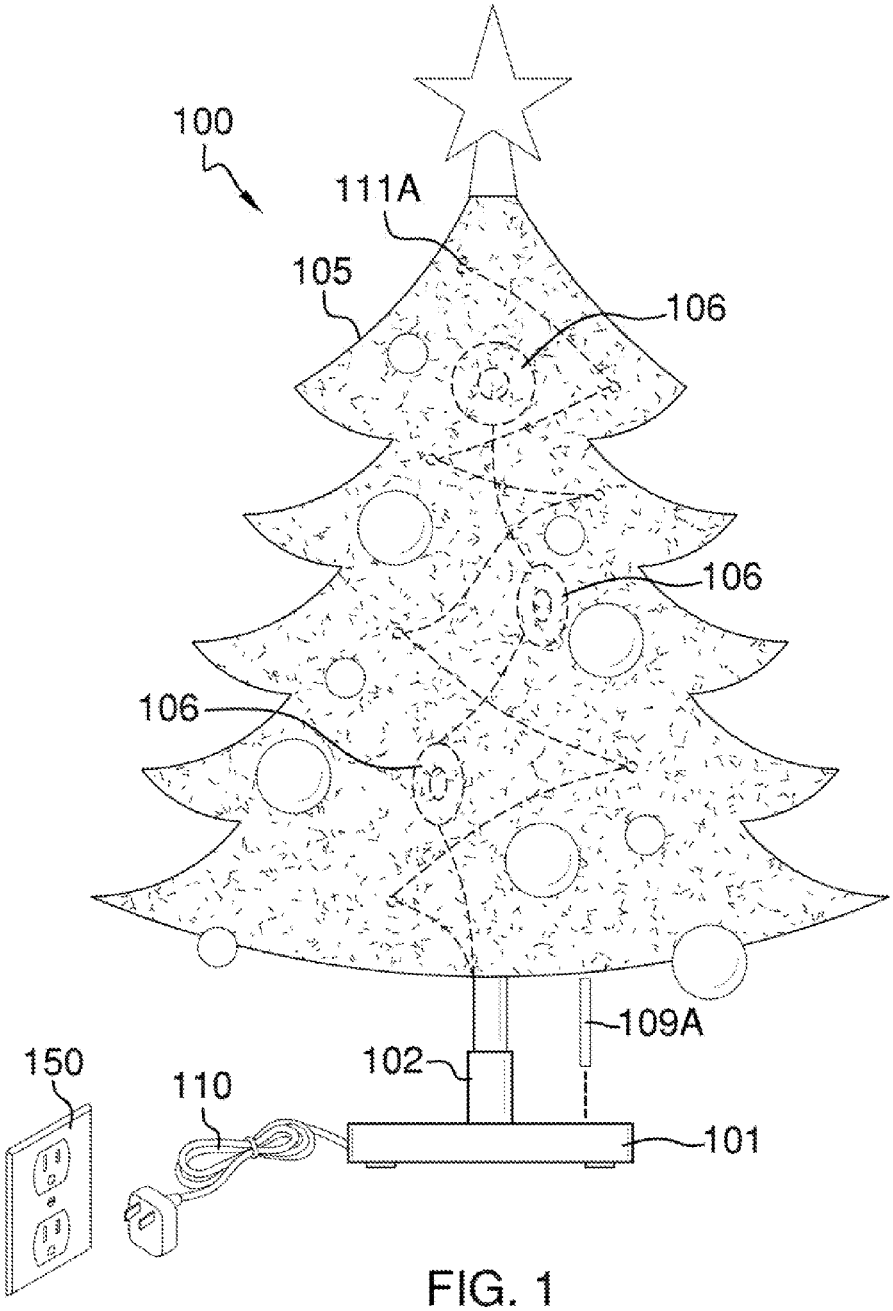
FIG. 1 illustrates a front view of the Christmas tree wherein the speakers are scattered along the height of the tree and are depicted in dashed lines, and an MP3 player is aligned above the MP3 player dock located on the stand.
Figure 2:
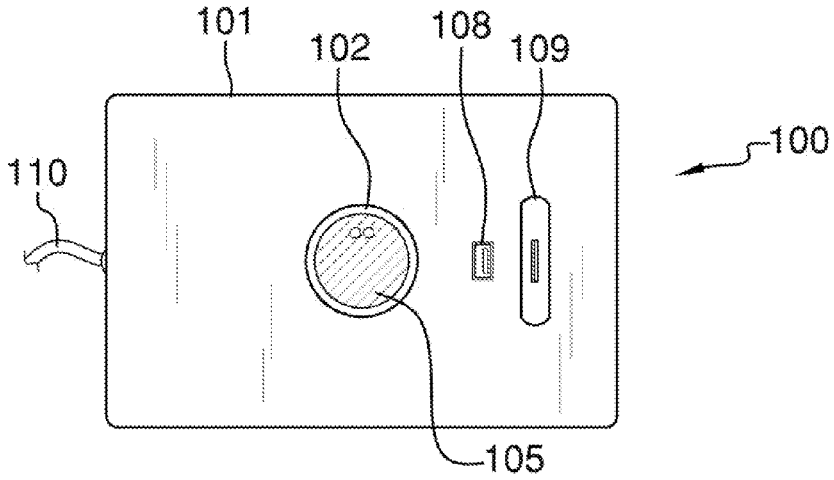
FIG. 2 illustrates a top view of the stand wherein the Christmas tree is cut across, and while depicting the location of the USB port and MP3 player dock.
Figure 3:
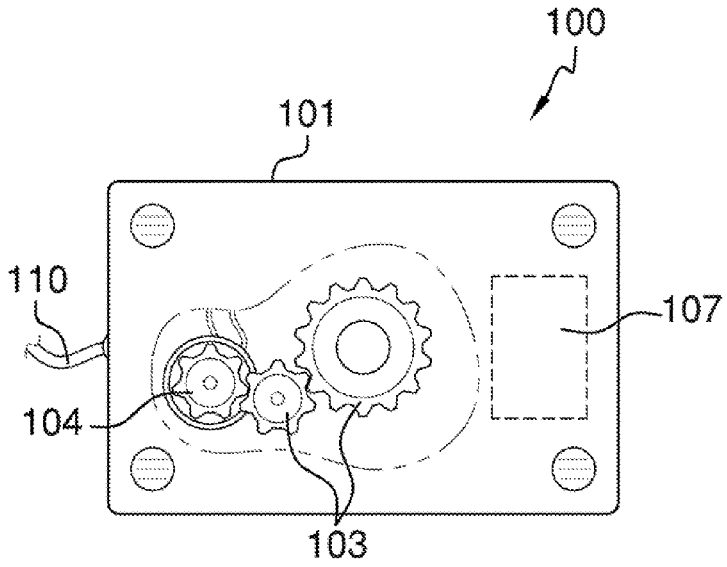
FIG. 3 illustrates a bottom cut-away view of the stand detailing the rotating means located within said stand, and depicting a computing means in dashed lines.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations.

All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-5. A Christmas tree 100 (hereinafter invention) includes a stand 101 including a rotating means 102 that is in mechanical connection with a gearing system 103. The gearing system 103 is in mechanical connection with a motor 104. Both the gearing system 103 and the motor 104 are located within the stand 101. The gearing system 103 is in mechanical connection between the motor 104 and the rotating means 102.

The motor 104 is capable of bi-directional output such that the rotating means 102 is capable of either clockwise or counterclockwise rotation. More particularly, the motor 104 is also capable of adjusting the rotational speed such that the speed output of the rotating means 102 can be adjusted.

Connected to the rotating means 102 is a Christmas tree 105. The Christmas tree 105 is ideally of a fake kind, which is preferable in that there is no maintenance of the Christmas tree 105 when compared to a real tree.

Figure 4:
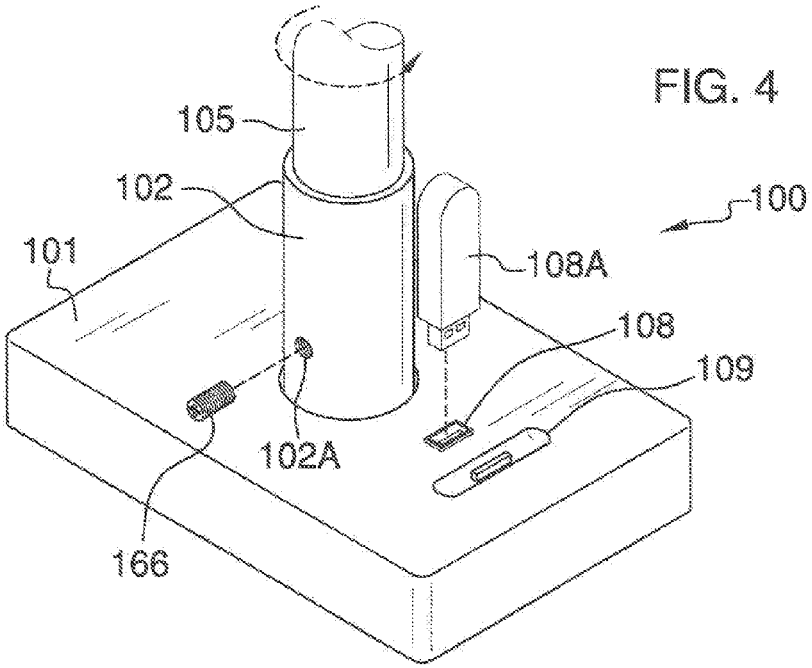
FIG. 4 illustrates a perspective view of the stand wherein a rotational arrow provides reference to the rotation of the Christmas tree with respect to said stand while a USB zip drive is aligned above the USB port.
Figure 4A:
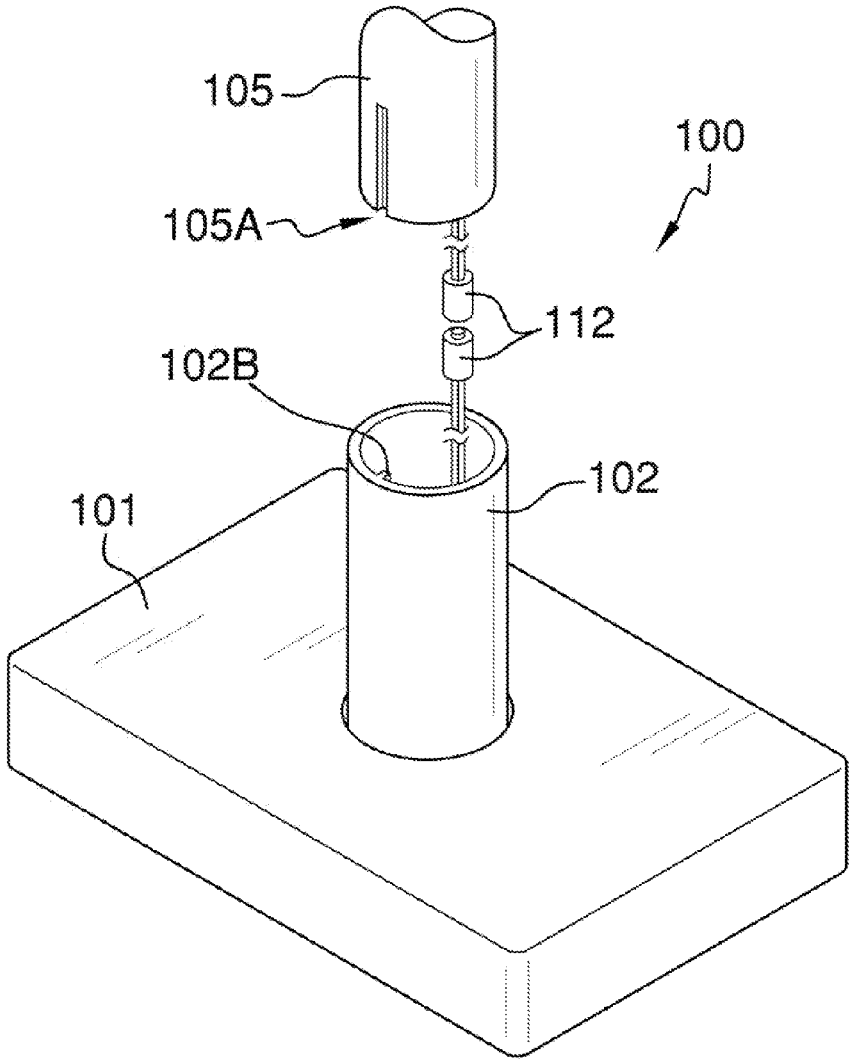

Referring to FIGS. 4 and 4A, the Christmas tree 105 is either permanently affixed to the rotating means 102 or is temporarily affixed to the rotating means 102. In referring to FIG. 4, the Christmas tree 105 is permanently affixed to the rotating means 102 via a locking means 166, which resembles a set screw that screws into a hole 102A located on the rotating means 102, which locks the two components together.

Referring to FIG. 4A, the rotating means 102 includes a notch 102B whereas the Christmas tree 105 includes a groove 105A. The groove 105A of the Christmas tree 105 is aligned above the notch 102B of the rotating means 102, and the Christmas tree 105 slides down into the rotating means 102. The weight of the Christmas tree 105 holds the Christmas tree 105 in place with respect to the rotating means 102.

The Christmas tree 105 is unique to the invention 100 over the prior art referred to above, in that the Christmas tree 105 includes speakers 106 that are positioned about the Christmas tree 105. The speakers 106 extend up the length of the Christmas tree 105, and may be at varying elevations with respect to the Christmas tree 105.

The stand 101 includes a computing means 107 that may be referred to as CPU. The computing means 107 is wiredly engaged to the motor 104, the speakers 106, a USB dock 108, and an MP3 player dock 109. Both the USB dock 108 and the MP3 player dock 109 are accessible from the stand 101, and enable audio to be played on the speakers 106. The USB dock 108 enables connection of a USB device 108A thereon; whereas the MP3 player dock 109 enables connection of a MP3 Player 109A or smart phone.

The computing means 107 is wiredly engaged to a power cord 110 so as to enable connection with a standard wall outlet 150.

Figure 5:
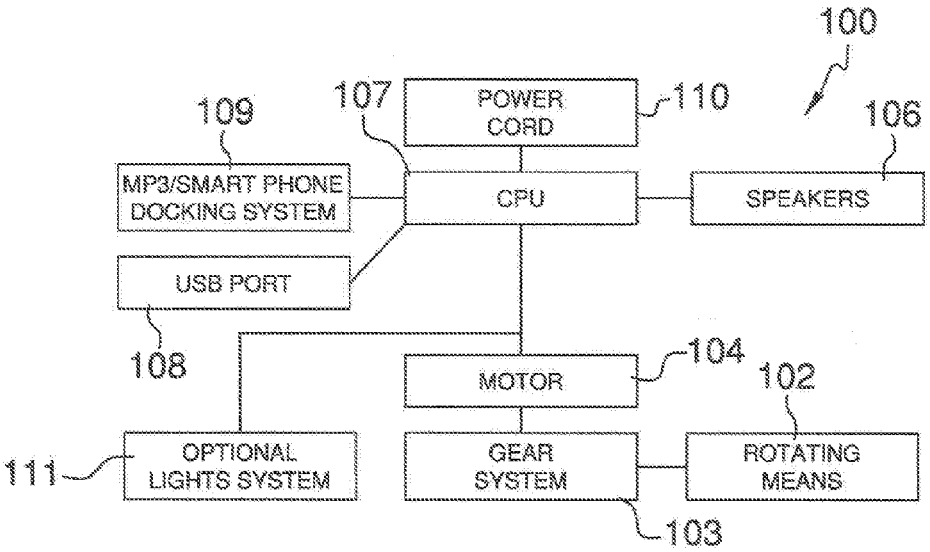
FIG. 5 illustrates a block diagram of the various components comprised to said Christmas tree.

Referring to the diagram of FIG. 5, the invention 100 may include a lighting system 111 that is wiredly connected with the computing means 107 and involves lights 111A about the Christmas tree 105.

Referring to FIG. 4A, the invention 100 would require the use of wire connectors 112 to enable connection and disconnection of the speakers 106 and/or lights system 111 in order to enable removal of the Christmas tree 105 from the rotating means 102. The wire connectors 112 would enable the wiring of both the speakers 106 and the optional light system 111 to connect and disconnect.

In summation, the computing means 107 can operate the output rotational speed and direction of the motor 104 thereby controlling speed and direction of rotation of the Christmas tree 105. Additionally, the computing means 107 can control the output of the speakers 106 in conjunction with the rotational movement of the Christmas tree 105. Additionally, the computing means 107 can control the lights, whether blinking or not, in addition to the rotation of the Christmas tree 105 and the output of the speakers 106.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The invention claimed is:

1. A Christmas tree comprising:

a Christmas tree; and a stand said stand having a rotating means that said Christmas tree is affixed thereto;

wherein the rotating means and said Christmas tree are rotatable with respect to the remainder of the stand;

wherein the stand includes docks for playing audio on at least one speaker located on the Christmas tree;

wherein a computing means located within the stand is wiredly connected between the docks and the speakers;

wherein the rotating means includes a gearing system in mechanical connection between the rotating means and a motor;

wherein the motor is in wired communication with the computing means; and wherein the rotational speed of the motor can be adjusted, which in turn controls an output speed of the rotating means.

2. The Christmas tree as described in 1 wherein the motor is bi-directional operable so that the Christmas tree can rotate either clockwise or counterclockwise with respect to the stand.

3. The Christmas tree as described in claim 1 wherein the Christmas tree is permanently affixed to the rotating means.

4. The Christmas tree as described in claim 1 wherein the Christmas tree is temporarily affixed to the rotating means.

5. The Christmas tree as described in claim 4 wherein wire connectors enable connection of the speaker to the computing means.

6. The Christmas tree as described in claim 1 wherein a light system is in wired communication with the computing means and includes a plurality of lights adorning the Christmas tree.

7. A Christmas tree comprising:

a Christmas tree; and a stand said stand having a rotating means that said Christmas tree is affixed thereto;

wherein the rotating means and said Christmas tree are rotatable with respect to the remainder of the stand;

wherein the stand includes docks for playing audio on at least one speaker located on the Christmas tree;

wherein a computing means located within the stand is wiredly connected between the docks and the at least one speaker;

wherein the rotating means includes a gearing system in mechanical connection between the rotating means and a motor;

wherein the motor is in wired communication with the computing means;

wherein the motor is bi-directional operable so that the Christmas tree can rotate either clockwise or counterclockwise with respect to the stand; and wherein the rotational speed of the motor is adjusted, which in turn controls an output speed of the rotating means.

8. The Christmas tree as described in claim 7 wherein the Christmas tree is permanently affixed to the rotating means.

9. The Christmas tree as described in claim 7 wherein the Christmas tree is temporarily affixed to the rotating means.

10. The Christmas tree as described in claim 9 wherein wire connectors enable connection of the speaker to the computing means.

11. The Christmas tree as described in claim 7 wherein a light system is in wired communication with the computing means and includes a plurality of lights adorning the Christmas tree.

* * * * *